US009033543B1

(12) United States Patent
Dai

(10) Patent No.: US 9,033,543 B1
(45) Date of Patent: May 19, 2015

(54) MINI SENSOR LAMP WITH INTERCHANGEABLE PLUG

(71) Applicant: Ningbo Weitao Electrical Appliance Co., Ltd., Ninghai, Zhejiang (CN)

(72) Inventor: Jiangang Dai, Zhejiang (CN)

(73) Assignee: NINGBO WEITAO ELECTRICAL APPLIANCE CO., LTD., Ninghai (CN)

( * ) Notice: Subject to any disclaimer, the term of this patent is extended or adjusted under 35 U.S.C. 154(b) by 7 days.

(21) Appl. No.: 14/080,802

(22) Filed: Nov. 15, 2013

(51) Int. Cl.

| | |
|---|---|
| ***F21V 9/00*** | (2006.01) |
| ***F21V 23/06*** | (2006.01) |
| ***F21K 99/00*** | (2010.01) |
| ***F21V 23/00*** | (2006.01) |

(52) U.S. Cl.
CPC . *F21V 23/06* (2013.01); *F21K 9/30* (2013.01); *F21V 23/005* (2013.01)

(58) Field of Classification Search
CPC ..... F21V 9/00
USPC ..... 362/231
See application file for complete search history.

(56) References Cited

U.S. PATENT DOCUMENTS

2011/0164415 A1* 7/2011 Chien ..... 362/231

* cited by examiner

*Primary Examiner* — Mary Ellen Bowman

(57) ABSTRACT

The present application is directed to a mini sensor lamp with interchangeable plug, including a round shaped plug and a coupled socket, the mini sensor lamp with interchangeable plug is provided with a safe activity piece device and a control circuit piece. The control circuit piece connects with copper foil. The copper foil adheres at one border side of the socket. A transparent pore is opened at one border side of the socket at the same time. A transparent lens is provided at the transparent pore. The light sensitive resistor of the control circuit piece is situated within the transparent lens. The control circuit piece is provided with LED lamp. At the jack of the round shaped plug is designed with a safe activity piece device.

4 Claims, 1 Drawing Sheet

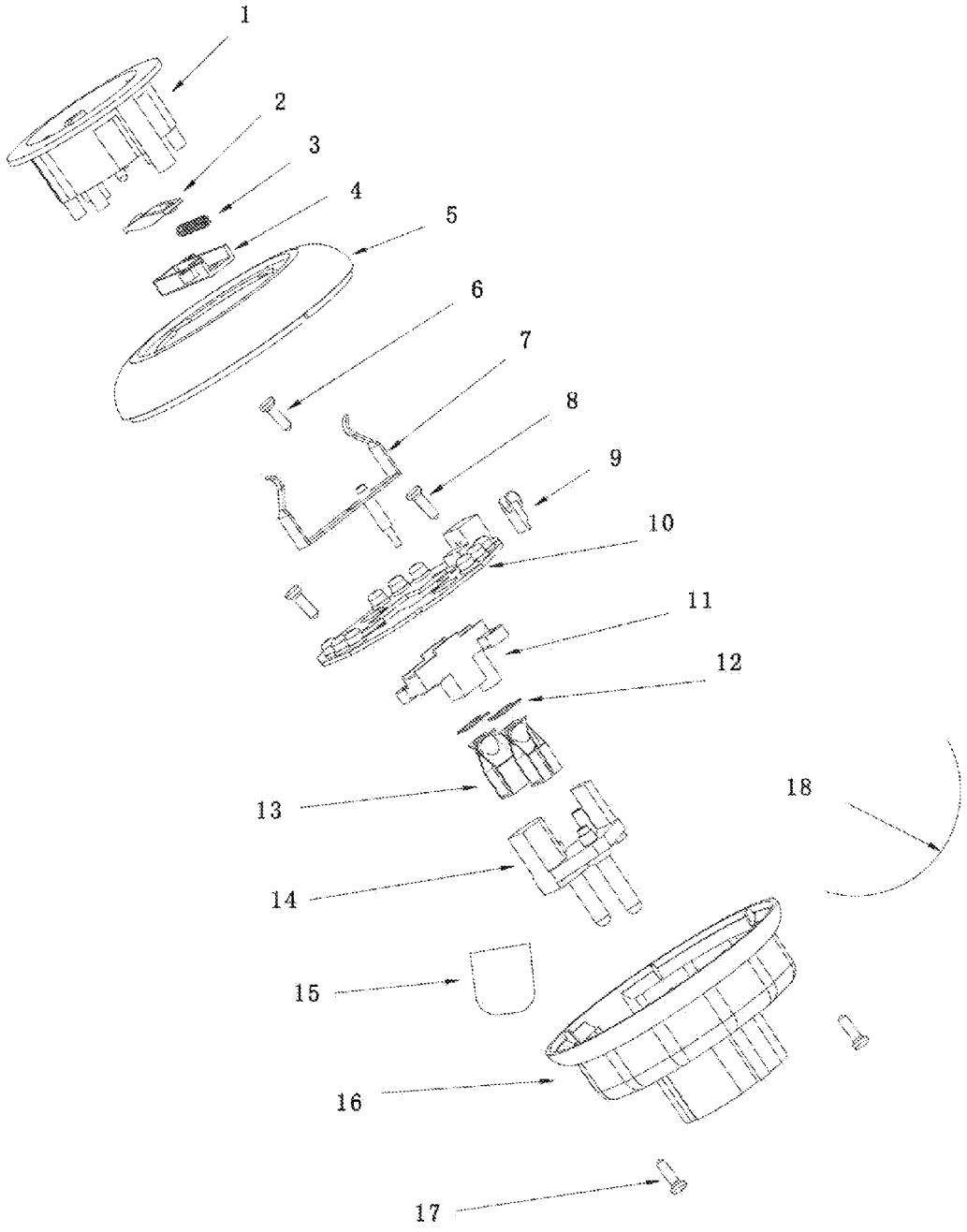
1
2
3
4
5
6
7
8
9
10
11
12
13
14
15
16
17
18

MINI SENSOR LAMP WITH INTERCHANGEABLE PLUG

FIELD OF THE TECHNOLOGY

The present application is directed to a mini sensor lamp with interchangeable plug.

BACKGROUND

For the interchangeable plugs available in the current market, general interchangeable plugs are not provided with light and hence one cannot find the corresponding jack under the dark. Even for the interchangeable plugs with LED lamp as disclosed in prior art, they apply the plugging-in and out mode of connection, and render inconvenience in usage. For the other general interchangeable plugs, their forms are susceptible to the surrounding and therefore pose a problem in security level.

SUMMARY

Directing against the above technical deficiency, the present application provides a mini sensor lamp with interchangeable plug.

In order to solve the above technical problem, the technical solution of the present application is provided as follows:

A mini sensor lamp with interchangeable plug, including a round shaped plug and a coupled socket. The interior of the round shaped plug is secured with a safe activity piece device. The plug is secured inside the socket. The plug protrudes the socket. The upper end of the plug is riveted with positive and negative plug-in pieces. The positive and negative plug-in pieces are inserted into the two jacks of the plug-in stationing base and the two jacks of the control circuit piece. The two jacks of the plug-in stationing base perform space limiting towards the positive and negative plug-in pieces. The top parts of the positive and negative plug-in pieces are covered with circlips. The control circuit piece connects to the copper foil. The copper foil adheres at one border side of the socket. A transparent pore is opened at one border side of the socket. The transparent pore is provided with a transparent lens. The light sensitive resistor of the control circuit piece is situated within the transparent lens. The control circuit piece is provided with LED lamp. The plug-in piece stationing base is provided with a concave trough. The concave trough is stably provided with a U-shaped ground-touching plug. The top part of the U-shaped ground-touching plug protrudes the round shaped plug. The jack of the safe activity piece device and the positive and negative plug-in pieces couple.

As a furtherance, the safe activity piece device includes a safe activity piece, an activity piece positioning rack and a spring. The activity piece positioning rack is secured on the round shaped plug. A spring is provided between the safe activity piece and the activity piece positioning rack. The safe activity piece can move horizontally along the activity piece positioning rack so as to realize the closing and opening status and resume to a closing status under the effect of the spring.

As a furtherance, the LED lamp is provided with three sets, with different sets of LED lamp possessing different colors.

As a furtherance, a transparent cover is provided between the round shaped plug and the socket. The round shaped plug, the transparent cover and the socket couple package together the safe activity piece device, unprotruded part of the socket in the plug, positive and negative plug-in pieces, plug-in piece stationing base, control circuit piece and unprotruded part of the round shaped plug in the U-shaped ground-touching plug.

The beneficial aspects in the present application lie in: the housing is round shaped. The exterior design is attractive with round and sleek appearance. Through the design in three layers of the round shaped plug, socket and transparent cover, the internal parts are packaged together. The jack of the round shaped plug is provided with a safe activity piece device. The jack of the safe activity piece of the safe activity piece device has a slanted surface. Therefore, when external electrical supply is required to be inserted, the safe activity piece moves horizontally along the activity piece positioning rack. When the external electrical supply is plugged-out, the safe activity piece resumes to a closing status under the effect of the spring, which safeguards from the danger of electric leakage. At the same time, the copper foil is tightly aligned at one border side of the socket so that when the fingers of the user is in contact with it, the user and the copper foil form an electric fusion. The control circuit piece senses through detecting the electric fusion such that the three LED lamps on the control circuit piece light up in a controlled fashion. The problem of lighting when inserting plug into jack under the dark is solved and the need for unique lighting is provided.

DETAILED DESCRIPTION OF THE DRAWINGS

FIG. 1 is an illustrative view of the structure of the present application.

Round shaped plug 1; safe activity piece 2; spring 3; activity piece positioning rack 4; transparent cover 5; a first screw 6; U-shaped ground-touching plug 7; a second screw 8; transparent lens 9; control circuit piece 10; plug-in piece stationing base 11; circlip 12; positive and negative plug-in pieces 13; plug 14; copper foil 15; socket 16; H-shaped screw 17; connecting line 18.

DETAILED DESCRIPTION

Below is a further description of the present application with reference to the combination of drawings and specific embodiments.

As illustrated by FIG. 1, the mini sensor lamp with interchangeable plug includes a round shaped plug 1 and a coupled socket 16. A safe activity piece device is secured within the round shaped plug 1 through a space limiting pole. The safe activity piece device includes a safe activity piece 2, an activity piece positioning rack 4 and a spring 3. The activity positioning rack 4 is secured on the round shaped plug 1. A spring 3 is provided between the safe activity piece 2 and the activity piece positioning rack 4. The safe activity piece can move horizontally along the activity piece positioning rack 4 so as to realize the closing and opening status, and resume to a closing status under the effect of the spring 3. The safe activity piece 2 is provided with a slanted surface at the jack, which ensures the safe activity piece 2 moves horizontally in a smooth way when external electrical supplies are plugged in. The DIN plug 14 is secured in the socket through the rivet. The two pins of the DIN plug 14 protrude the socket 16. On the upper end of the DIN plug 14 is riveted with positive and negative plug-in pieces 13 for conducting electricity. The positive and negative plug-in pieces 13 are inserted into the two jacks of the plug-in piece stationing base 11 and the two jacks of the control circuit piece 10, respectively. The two jacks of the plug-in piece stationing base 11 and the two jacks of the control circuit piece 10 are mutually coupled, that is, the control circuit piece 10 can tightly align the upper surface of the plug-in piece stationing base 11. The two jacks of the plug-in piece stationing base 11 match with the positive and negative plug-in pieces to perform space limiting. The top parts of the positive and negative plug-in pieces 13 is covered with circlips 12. The circlips 12 clutch tightly the positive and negative plug-in pieces 13 and give them resiliency, which ensures they return to original shape after the external electrical supply is plugged-out. The control circuit piece 10 connects to the copper foil 15 through a connecting line 18. The copper foil 15 adheres at the border side of the side of the socket 16, and in application, the copper foil 15 together with the finger of user in contact form an electric fusion. The control circuit piece 10 detects the changes in the electric fusion and can then make a determination. A transparent pore is opened at the same time at one side of the side border of the socket 16. The transparent pore is provided with a transparent lens 9. The light sensitive resistor of the control circuit piece 10 is situated inside the transparent lens 9, and the light sensitive resistor and transparent lens 9 stick stably at one side of the side border of the socket 16 through a plastic piece. The control circuit piece 10 is provided with three sets of LED lamps, with different sets of LED lamps possessing different colors. The plug-in piece stationing base 11 is provided with a concave trough. The concave trough is secured with a U-shaped ground-touching plug 7. The top part of the U-shaped ground-touching plug 7 protrudes the round shaped plug 1. The jack of the safe activity piece device couples with the positive and negative plug-in pieces. A transparent cover 5 is provided between the round shaped plug and the socket. The round shaped plug 1, transparent cover 5 and socket 16 couple and package together the safe activity piece device, unprotruded part of the socket in the plug, positive and negative plug-in pieces 13, plug-in piece stationing base 14, control circuit piece 10 and unprotruded part of the round shaped plug in the U-shaped ground-touching plug 7. In particular, H-shaped screw 17 is used as fixation between the round shaped plug 1 and the socket 16. The control circuit piece 10 is secured on the socket 16 using the second screw 8. The U-shaped ground-touching plug 7 is secured at the concave trough of the plug-in piece stationing base 11 using the first screw 6.

The above is merely a preferred embodiment in the present application. It should be emphasized that for the skilled in the art and under the condition of not departing from the inventive concept, one can perform many improvement and refurbishment which shall be taken as falling within the protection scope of the present application.

The invention claimed is:

1. A mini sensor lamp with interchangeable plug, comprising a round shaped plug and a coupled socket, the interior of the round shaped plug is secured with a safe activity piece device, the plug is secured within the socket, the plug protrudes the socket, the upper end of the plug is riveted with positive and negative plug-in pieces, the positive and negative plug-in pieces insert into the two jacks of the plug-in stationing base and the two jacks of the control circuit piece, the two jacks of the plug-in stationing base match with the positive and negative plug-in pieces and perform space limiting, circlips are provided at the top part of the positive and negative plug-in pieces, the control circuit piece is connected with copper foil, the copper foil adheres at one border side of the socket, a transparent pore is opened at the same time at one border side of the socket, a transparent lens is provided at the transparent pore, a light sensitive resistor of the control circuit piece is provided within the transparent lens, the control circuit piece is provided with LED lamp, the plug-in stationing base is provided with concave trough, the concave trough is stably provided with U-shaped ground-touching plug, the top part of the U-shaped ground-touching plug protrudes the round shaped plug, the jack of the safe activity piece device and the positive and negative plug-in pieces couple.

2. The mini sensor lamp with interchangeable plug according to claim 1, wherein the safe activity piece device comprises a safe activity piece, an activity piece positioning rack and a spring, the activity positioning rack is secured on the round shaped plug, a spring is provided between the safe activity piece and the activity piece positioning rack, the safe activity piece can move horizontally along the activity piece positioning rack so as to realize the closing and opening status and resume the closing status under the effect of the spring.

3. The mini sensor lamp with interchangeable plug according to claim 1, wherein the LED lamp is provided with three sets, with different sets of LED lamps possessing different colors.

4. The mini sensor lamp with interchangeable plug according to claim 1, wherein a transparent cover is provided between the round shaped plug and the socket, the round shaped plug, the transparent cover and the socket couple and package together the safe activity piece device, unprotruded part of the socket in the plug, positive and negative plug-in pieces, plug-in piece stationing base, control circuit piece and unprotruded part of the round shaped plug in the U-shaped ground-touching plug.

* * * * *